US005389907A

United States Patent [19]

Gurol et al.

[11] Patent Number: 5,389,907

[45] Date of Patent: Feb. 14, 1995

[54] HIGH TEMPERATURE SUPERCONDUCTOR MULTIPOLE CORRECTORS FOR PARTICLE ACCELERATORS

[75] Inventors: Husam Gurol, Encinitas, Calif.; Robert W. Baldi, Mandeville, La.

[73] Assignee: General Dynamics Corporation, San Diego, Calif.

[21] Appl. No.: 133,687

[22] Filed: Oct. 7, 1993

[51] Int. Cl.[6] ..... H01F 7/22

[52] U.S. Cl. ..... 335/216; 335/213; 335/299

[58] Field of Search ..... 335/210–214, 335/216, 296–301; 505/1, 705, 879; 324/318, 319, 320; 315/8, 5.35, 5.41; 328/162, 165, 166, 227, 228, 230, 233

[56] References Cited

U.S. PATENT DOCUMENTS 4,135,127 1/1979 Khanna et al. ..... 336/DIG. 1

*Primary Examiner*—Leo P. Picard
*Assistant Examiner*—Raymond Barrera
*Attorney, Agent, or Firm*—John R. Duncan; Frank D. Gilliam

[57] ABSTRACT

A method and apparatus for correcting harmonics (multipoles) in high energy particle accelerators using superconducting magnets using a pattern of superconducting bands adjacent to the accelerator magnets. In such accelerators, superconducting coils are positioned around a non-magnetic beam tube with the magnetic coils designed to guide particles, such as protons, along the tube. Magnetic field non-uniformities in the form of multipole harmonics will disrupt the beam guidance, causing particles to hit the tube walls and be lost, reducing accelerator efficiency. The negative effects of multipoles (harmonics) in such accelerators can be reduced or eliminated by positioning a non-magnetic tube bearing a pattern of longitudinal superconducting bands, connected by circumferential band segments around the exterior of the helium vessel or other suitable surface near the magnet ends. The bands are formed from a superconductor having a critical temperature above the boiling temperature of liquid nitrogen. The longitudinal bands are equally spaced and lie parallel to the beam tube axis. The bands negate the field non-uniformities generated by the unavoidable multipoles generated by the magnetic coils. Where a number of magnets from different vendors, using somewhat different materials, etc., must be used together, often different sets of magnets have different harmonic characteristics. The tunable corrector band patterns will allow these manufacturing variations to be corrected in each set. The multipole harmonic effects for each set is measured through empiric tests, and the dimensions of the corrector band patterns are selected for use with that set.

12 Claims, 1 Drawing Sheet

HIGH TEMPERATURE SUPERCONDUCTOR MULTIPOLE CORRECTORS FOR PARTICLE ACCELERATORS

BACKGROUND OF THE INVENTION

This invention relates in general to superconducting accelerator magnets and, more specifically to a method and apparatus for passively correcting for variations in magnetic field uniformity between different, though identically designed, magnets.

Magnetic fields guide particles, such as protons, through beam tubes. Particles can be accelerated to speeds approaching the speed of light by accelerators made up of a number of axially arranged high field magnets, with beam tubes under high vacuum that contain the particles.

In high energy physics research, such magnets have been used to accelerate and guide particles and cause collisions between them, revealing the presence of more fundamental particles and forces. Particle accelerators are also used in medical research and treatment, where tissues are bombarded with selected particles to change or destroy selected types of tissue, such as tumors. Other applications include x-ray lithography and protein crystallography.

Superconductors are materials, typically metals or ceramics, that lose all resistance when cooled below a critical temperature. Many materials have superconducting capabilities, although most only superconduct at temperatures approaching 0° K. The most practical superconductors for use in superconducting magnets are those that superconduct at or above the boiling temperature of liquid helium; NbTi and $Nb_3Sn$ are the most commonly used superconducting materials. Recently, ceramic superconductors, such as $YBa_2Cu_3O_7$ have been developed that have critical temperatures above the boiling temperature of liquid nitrogen.

Magnets formed from superconductors and cooled below their critical temperatures are highly efficient and can provide extremely high magnetic fields. Such magnets are used in particle accelerators used in medical treatment, physics research and other fields. The Superconducting Supercollider will use thousands of superconducting magnets to guide particles through a very long, multi-magnet beam tube. These magnets require very high field uniformity in order to guide the particle beam through the beam tube without an excessive number of particles striking the inner surface of the tube and lost. The high field uniformity requirement in turn imposes very high tolerances for the parts and assembly of the magnets. Significant sources of error, in addition to assembly and random error stack-up, include the use of superconductors and other parts from different vendors. Magnetic non-uniformities or "multipoles" that exist in accelerator magnets have historically shown significant variations between different sets of magnets. Unless controlled, the large values of multipoles, as well as the magnet-to-magnet variability, can result in shorter accelerator operation times and hence increased accelerator costs. Greater control of the multipoles will allow broader manufacturing tolerances which will substantially lower the cost of accelerator magnet systems while improving performance. For example, collars are used to secure the magnet coils around the beam tube. It has been found that variations in the tightness of these collars from set to set of manufactured magnets are particularly significant in varying the persistent current and harmonic effects from set to set. In the past, attempts were made to use active corrector magnets positioned at selected locations in the system. These magnets, however, were not particularly effective, were difficult to fit into the system and significantly increased system cost. Similarly, attempting to enforce very tight tolerances is very expensive, often causing the rejection of a large percentage of completed magnets as out-of-tolerance.

Thus, there is a continuing need for methods of correcting variations in magnet multipoles between different sets of magnets.

SUMMARY OF THE INVENTION

The above noted problems, and others, are overcome in accordance with this invention, basically, by securing a circular tube of non-magnetic material around the end regions of the magnetic coils of an accelerator helium vessel, the tube bearing a pattern of superconductive bands formed from a superconductor composition having a critical temperature above the temperature of liquid nitrogen. Basically, the superconductor band pattern includes equally spaced longitudinal bands lying parallel to each other and to the axis of the magnet, with circumferential bands alternately connecting opposite ends of the longitudinal portions, so that all portions together make up a continuous electrical path.

After a set of particle accelerator magnets is manufactured, established testing methods are used to measure the harmonic characteristics (multipoles) of sample magnets from the set. The dimensions and locations of the superconducting corrector bands are then selected to reduce any variations of the multipoles from the desired norm. With newly designed magnets, the selection of thickness, width, spacing, etc. of the corrector bands will be based on iteration. With some experience with the degree of variability the magnets are exhibiting, the corrector configurations will become predictable. Computer simulations will aid in reducing the empirical establishment of standards for the corrector bands.

The corrector tube may have any suitable dimensions, depending on the outside diameter of the vessel (typically the helium vessel) around which it is positioned and the length of the magnet coil end portions. The tube may be formed of any suitable non-magnetic material such as suitable stainless steels, glass fiber reinforced synthetic resins or the like. Any suitable thickness may be used, with thin but self supporting tubes being preferred.

Any suitable superconducting material may be used that has a critical temperature, (the temperature below which the material loses all electrical resistance), above the temperature of liquid nitrogen. Typical such superconductors include $YBa_2Cu_3O_7$ and other "high $T_c$" superconductors as described, for example, in the book "Superconductors", Simon and Smith, Plenum Publishing Corporation, New York, 1988, which also describes a number of methods of forming films and layers from such superconductors. The superconducting bands may be made by any conventional method.

The number of longitudinal bands will be selected in accordance with the particular harmonic (multipole) to be corrected. In most cases, primary consideration will be given to correcting the $b_2$ sextuple harmonic. In that case, four equally spaced longitudinal bands are preferred. While any suitable superconductor band thickness may be used, in general thicknesses in the range of from about 1 to 100 micro-meters are preferred. Optimum band width and length of longitudinal bands will depend somewhat on the size of the superconducting accelerator magnet, the harmonics to be corrected and other variables. With accelerator magnets of the sort used as the dipole magnets in the Superconductive Supercollider, bands having widths of from about 0.5 to 1.5 inch and longitudinal bands of lengths in the about 10 to 30 inch range are preferred. While the bands may be formed in any suitable manner, electrodeposition onto the masked tube surface is preferred. However, while the optimum layout of bands is being empirically determined, tapes having the superconductor material formed on the surface may be used to make tentative, variable, layouts for testing. Once an optimum arrangement is selected for a particular accelerator magnet configuration, it is preferred that permanent bands be directly formed on the tube surface.

We have found that the superconductive band material carries an induced current at the field levels used during injection of the particle beam into the beam tube during system start-up that corrects for the harmonics, allowing rapid and effective beam injection. Typical beam injection fields will be about 0.7 Tesla with a system which is to be operated at about 7 Tesla. Typically, beam injection takes about 30 minutes, with the accelerator typically operating for about 24 hours continuously maintaining the particle stream. It is apparent that any significant loss of particles to the beam tube walls will severely reduce the effectiveness of the system over such periods.

BRIEF DESCRIPTION OF THE DRAWING

Details of the invention, and of certain preferred embodiments thereof, will be further understood upon reference to the drawing, wherein.

DETAILED DESCRIPTION OF PREFERRED EMBODIMENTS

Figure 1:
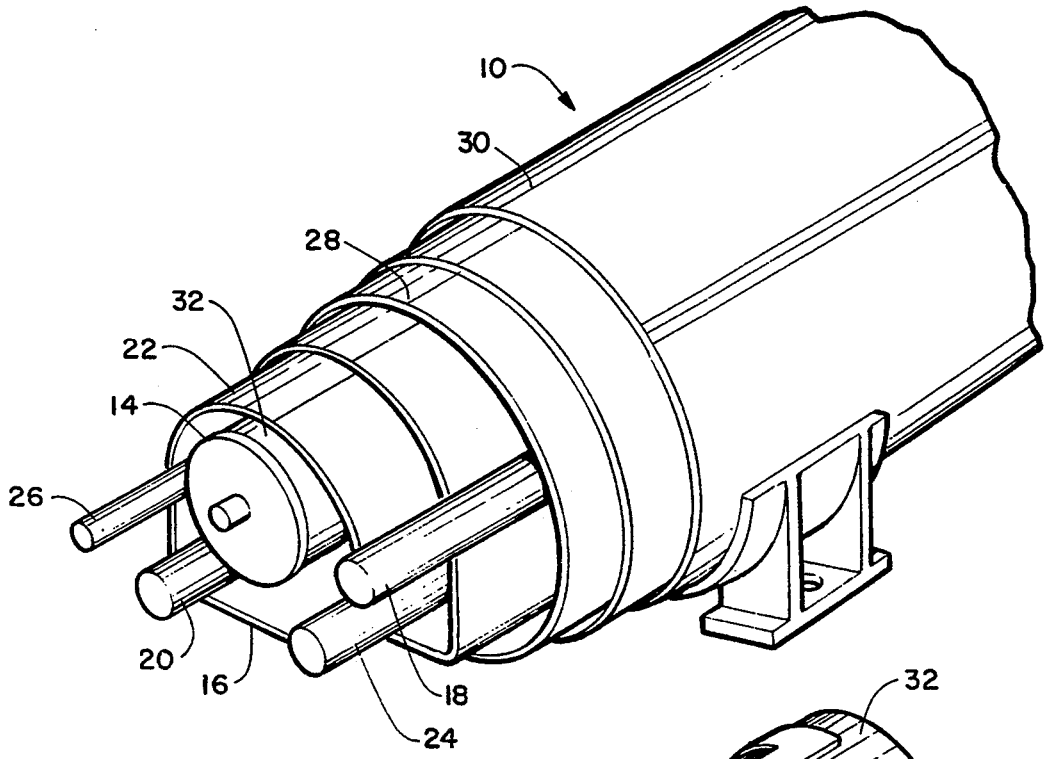
FIG. 1 is a perspective view of a typical particle accelerator magnet assembly, partially cut-away to show the corrector band location.

Referring now to FIG. 1, there is seen a perspective view of a particle accelerator magnet assembly 10 with the near end partially cut-away to show the internal components. This accelerator is typical of the main dipole magnets which guide particles in the Superconducting Supercollider.

Figure 3:
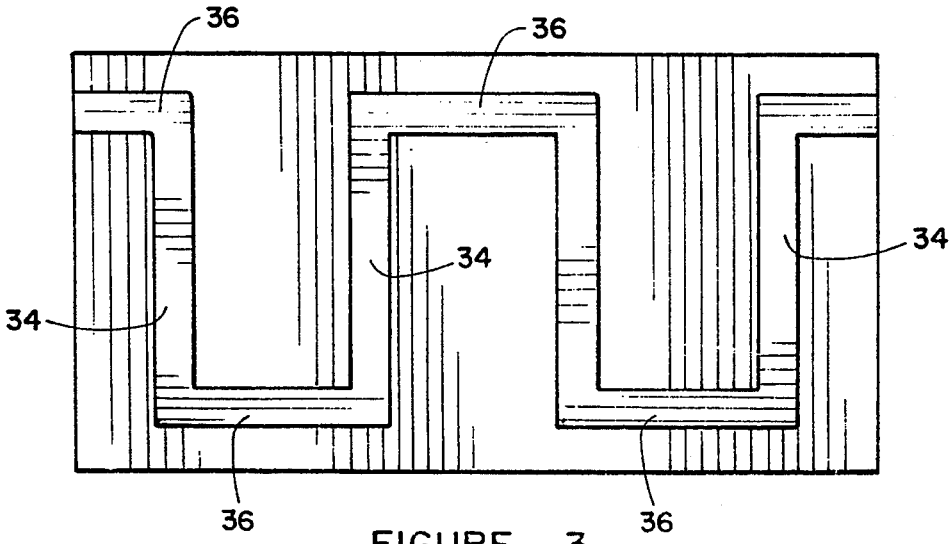
FIG. 3 is a schematic representation of the tube of FIG. 2, axially cut longitudinally and flattened to show the entire band pattern.

At the center of assembly 10 is the beam tube 12 that carries the stream of particles at extremely high velocity, near the speed of light. Surrounding beam tube 12 is a helium vessel 14 that contains the superconducting magnetic coils (as seen in FIG. 3) that surround beam tube 12. The coils are conventionally formed from superconducting alloys that have critical temperatures above the boiling temperature of liquid helium, so that they are superconducting when maintained at liquid helium temperatures.

A 20° K. shield or housing 16 surrounds helium vessel 14. Line 18 brings liquid helium to vessel 14 while line 20 removes gaseous helium. Surrounding the 20° K. shield is an 80° K. shield or housing 22 containing liquid nitrogen to reduce heat flow to the inner components. Liquid nitrogen is brought to shield 22 through line 24 and gaseous nitrogen is removed through line 26. Liquid nitrogen is much less expensive than liquid helium, so that benefits derive from absorbing heat in the liquid nitrogen rather than the liquid helium. In the future, as the recently developed high temperature superconductors that have critical temperatures just below the boiling temperature of liquid nitrogen become commercially available, the helium system may no longer be needed.

Multiple layers of high efficiency thermal insulation material 28 surround the shield assembly to further reduce heat flow into the system. An outer vacuum vessel 30 surrounds the entire assembly. Much of the system insulation is accomplished by the vacuum.

Tube 32 fits over the ends of helium vessel 14 and can be secured there to in any suitable manner, such as set screws through tube 32 bearing on helium vessel 14, welding, adhesive bonding, etc.

Figure 2:
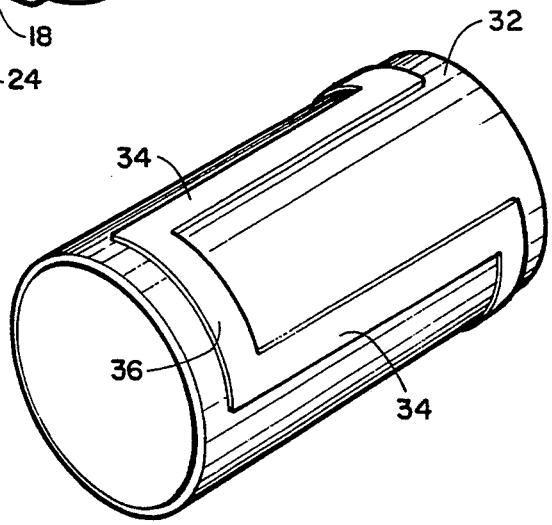
FIG. 2 is a schematic perspective view of the corrector tube and superconductive band assembly.

As seen in FIGS. 2 and 3, the superconductive bands include plural, typically 4, substantially equally spaced longitudinal bands 34 with the opposite ends connected alternatively to adjacent longitudinal bands 34 by circumferential band segments 36. During the beam injection phase of magnet operation, as detailed above, induced currents flow along these bands, serving to correct the magnetic field to reduce or eliminate multipole harmonics.

The Superconductive Supercollider uses approximately 8 thousand 15 meter magnet assemblies. Other large superconducting magnet assemblies for medical, physics research and other uses will also use large number of magnets. Different sets or groups of magnets may be made by different vendors, may use different lots of superconductor material or other material etc. While all of the magnets in one lot may be similar and have tight manufacturing tolerances, magnets from different lots may exhibit significant variations. For example, one component, the collars that hold the superconducting coils against the beam tubes, has been found to vary somewhat from lot to lot. We have found that random variations can generally be accommodated by the system. However, a consistent variation, such as where each magnet slightly misdirects the particle beam in the same manner, may cause an accumulating error that rapidly becomes a significant problem in maintaining correct particle flow over long periods. Thus, the use of identical patterns of corrector bands in each of a specific lot of magnets can reduce or eliminate these accumulating errors.

The optimum patterns, dimensions and locations of superconductor corrector bands for a specific set of substantially identical magnet assemblies is determined by trial and error, initially, with the assistance of experience and computer simulations where available. Once the optimum arrangement is determined and confirmed by magnet tests, the same arrangement is installed in all of the other magnets of that set.

Other applications, variations and ramifications of this invention will occur to those skilled in the art upon reading this disclosure. Those are intended to be included within the scope of this invention, as defined in the appended claims.

We claim:

1. A superconductive corrector system for correcting magnetic field variations due to multipole harmonics in superconducting accelerator magnet systems having a beam tube through which particles are accelerated, surrounded by a superconducting magnet coil array and a liquid helium vessel, which comprises:

a corrector tube of non-magnetic material adapted to slide over an end of an accelerator magnet system;

a pattern of superconductive bands formed on the surface of said corrector tube;

said superconductive bands formed from a superconductor having a critical temperature above the boiling temperature of liquid nitrogen;

said superconductive bands including an even-numbered plurality of substantially equally spaced longitudinal bands arranged to lie substantially parallel to each other and to the axis of the beam tube when said corrector tube is in place on the helium vessel; and said superconductive bands further including circumferential band segments connecting adjacent ends of said longitudinal bands alternately at opposite ends of the array of parallel longitudinal bands.

2. The system according to claim 1 wherein said tube is formed from a material selected from the group consisting of non-magnetic stainless steel and glass fiber reinforced synthetic resin.

3. The system according to claim 1 wherein said bands have thicknesses of from about 1 to 100 micrometers.

4. The system according to claim 1 wherein said bands have widths of from about 0.5 to 1.5 inch and said longitudinal bands have lengths of from about 10 to 30 inches.

5. The system according to claim 1 wherein said corrector tube fits over the end of the accelerator magnet system helium vessel.

6. The system according to claim 1 wherein 4 longitudinal bands are provided to correct the $b_2$ sextuple harmonic.

7. The method of correcting magnetic field variations due to multiple harmonics in superconducting accelerator magnet systems having a beam tube through which particles are accelerated, surrounded by a superconducting magnet coil array and a liquid helium vessel, which comprises the steps of:

providing a corrector tube of non-magnetic material adapted to slide over an end of an accelerator magnet system;

forming a pattern of superconductive bands on the surface of said corrector tube, said superconductive bands including an even-numbered plurality of substantially equally spaced longitudinal bands arranged to lie substantially parallel to each other and to the axis of the beam and including circumferential band segments connecting adjacent ends of said longitudinal bands alternately at opposite ends of the array of parallel longitudinal bands; and positioning said corrector tube around at least one end of a superconducting accelerator magnet.

8. The method according to claim 7 including forming said tube from a material selected from the group consisting of non-magnetic stainless steel and glass fiber reinforced synthetic resin.

9. The method according to claim 7 wherein said bands are formed to thicknesses of from about 1 to 100 micro-meters.

10. The method according to claim 7 wherein said bands are formed to widths of from about 0.5 to 1.5 inch and said longitudinal bands have lengths of from about 10 to 30 inches.

11. The method according to claim 7 wherein said corrector is fitted over the end of the accelerator magnet system helium vessel.

12. The method according to claim 1 wherein 4 longitudinal bands are provided to correct the $b_2$ sextuple harmonic.

* * * * *